US005967960A

United States Patent [19]

Foldesi, Sr.

[11] Patent Number: 5,967,960

[45] Date of Patent: Oct. 19, 1999

[54] CLOSURE LINING MACHINE

[76] Inventor: Steve Foldesi, Sr., Commerce St., Hinesburg, Vt. 05461

[21] Appl. No.: 09/027,749

[22] Filed: Feb. 23, 1998

[51] Int. Cl.[6] ..... B23Q 17/00

[52] U.S. Cl. ..... 493/75; 413/58; 493/74

[58] Field of Search ..... 493/61, 62, 73, 493/74, 75, 93, 94, 343, 372; 413/9, 58, 63, 64; 221/265, 266

[56] References Cited

U.S. PATENT DOCUMENTS

| | | | |
|---|---|---|---|
| 1,152,395 | 9/1915 | Butler . | |
| 1,299,170 | 4/1919 | Gray | 413/64 |
| 1,328,020 | 1/1920 | Synonds . | |
| 1,809,341 | 6/1931 | Jensen . | |
| 1,823,946 | 12/1931 | Johnson . | |
| 1,832,399 | 11/1931 | Johnson . | |
| 2,598,028 | 5/1952 | Andrew et al. | 113/80 |
| 3,546,768 | 12/1970 | Acton et al. | 493/74 X |
| 3,550,546 | 12/1970 | Eikenhorst | 113/1 |
| 4,004,529 | 1/1977 | Grotnes | 72/29 |
| 4,267,009 | 5/1981 | Eddy | 493/27 X |
| 4,330,290 | 5/1982 | Focke | 493/372 |
| 4,568,406 | 2/1986 | Kieran et al. | 156/355 |
| 4,605,351 | 8/1986 | Hatcher et al. | 413/58 |
| 4,728,239 | 3/1988 | Kieran et al. | 413/64 |

*Primary Examiner*—David A. Scherbel
*Assistant Examiner*—Anthony Ojini
*Attorney, Agent, or Firm*—Charles E. Temko

[57] ABSTRACT

A device for lining container closures in which a punch cuts undivided lining pieces from a strip of web material and pushes the piece through a die to seat the same within an individual closure. The closures are advanced by a pocket wheel having two oppositely disposed pockets driven through 180 degree increments in alternate directions to discharge lined closures from either side of the pocket wheel enclosure. The pocket wheel is driven by a rotary actuator which may be electrically, pneumatically, or hydraulically powered.

4 Claims, 3 Drawing Sheets

CLOSURE LINING MACHINE

BACKGROUND OF THE INVENTION

This invention relates generally to the field of closure lining machines used for placing a circular liner of resilient material on an inner surface of an end wall of a closure, typically, a threaded cap used for sealing soft drink containers and the like. In such machines, it is conventional to provide a continuous web of material from which the liners are cut by a punch and die mechanism, the punch pushing the cut liners through the die and into a cavity in the cap. The caps are incrementally advanced using a pocket wheel within an enclosure, the pocket wheel serially advancing pockets to present a fresh cap beneath the punch and die mechanism for cyclic operation.

Typically, the pocket wheel is advanced a short angular distance for each cycle using a globoidal indexer, or a Geneva cam. These devices are operated by a motor driven drive shaft which drives the input shaft of the indexer, using a chain or a timing belt, a relatively expensive construction.

SUMMARY OF THE INVENTION

Briefly stated, the invention contemplates the provision of an improved device of the class described in which the cost of manufacture has been significantly reduced by simplification of the component parts. To this end, the pocket wheel is of significantly smaller diameter, and contains a relatively few number of pockets. In lieu of an expensive indexing mechanism, the pocket wheel is alternately advanced through 180 degrees using a rotary actuator, the operation of which is programmed in synchronism with the operation of the punch element and web advancement means. The rotary actuator may be of a vane type or a rack and pinion type, preferably operated pneumatically to eliminate not only the need for a conventional indexing means, but the motor drives associated with the indexing means.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
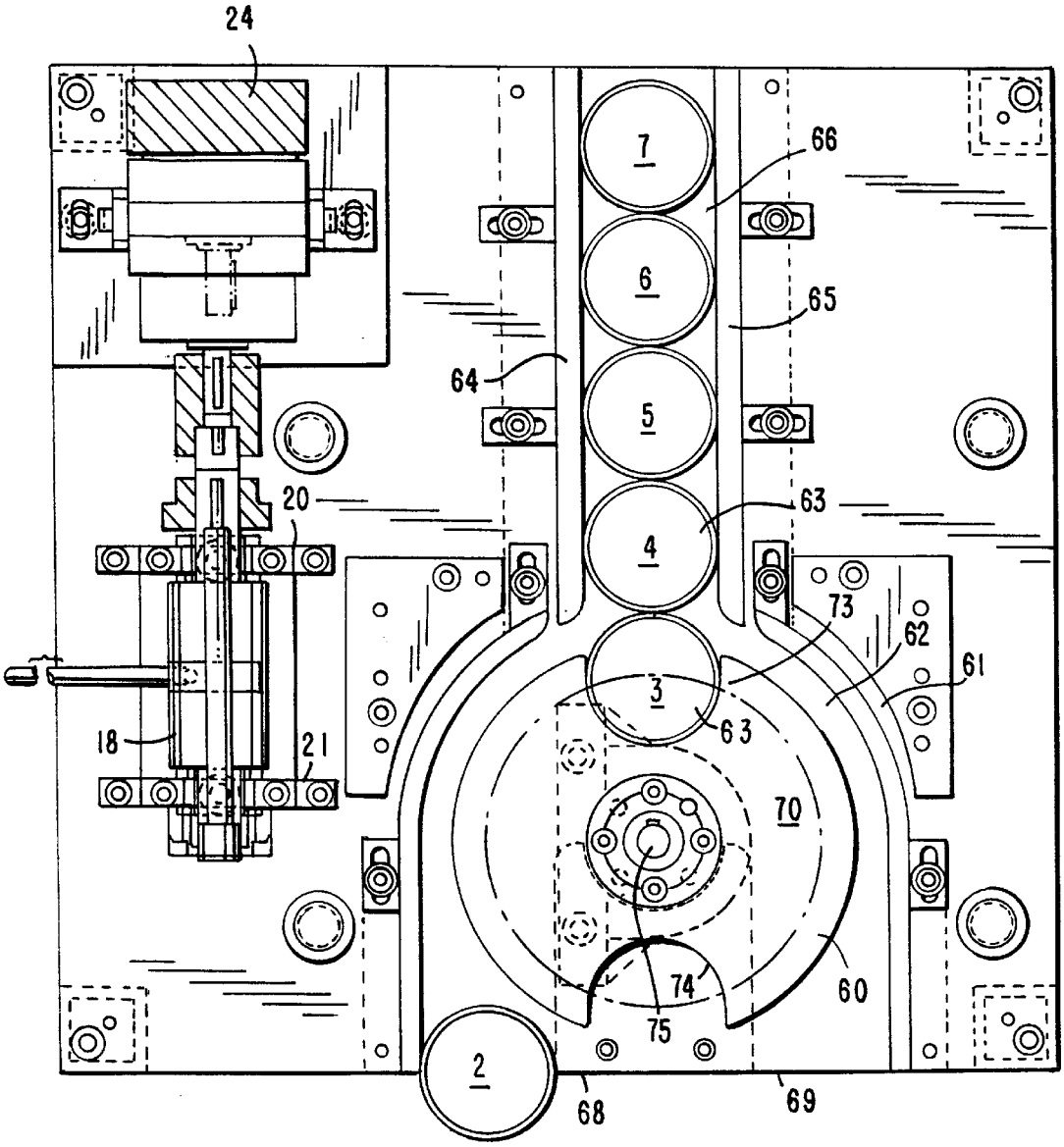
FIG. 1 is a schematic top plan view of an embodiment, of the invention.

In accordance with the invention, the device, generally indicated by reference character 10 includes a main table top 11 supported upon a plurality of legs 12. The table top supports a web advancement element 13, a punch and die element 14, and a closure advancement element 15.

The web advancement element 13 is generally conventional (see FIGS. 1 and 2), and includes first and second supporting frames 20 and 21, a lower powered roller 22, and an upper nip roller 33. The lower roller 22 is driven by a vane actuator 24 which is computer controlled in synchronism with operation of the punch and die element 14. The actuator drives a clutch coupler 18 and will periodically advance a web (not shown) of resilient material from which the liners are severed in known manner.

Figure 2:
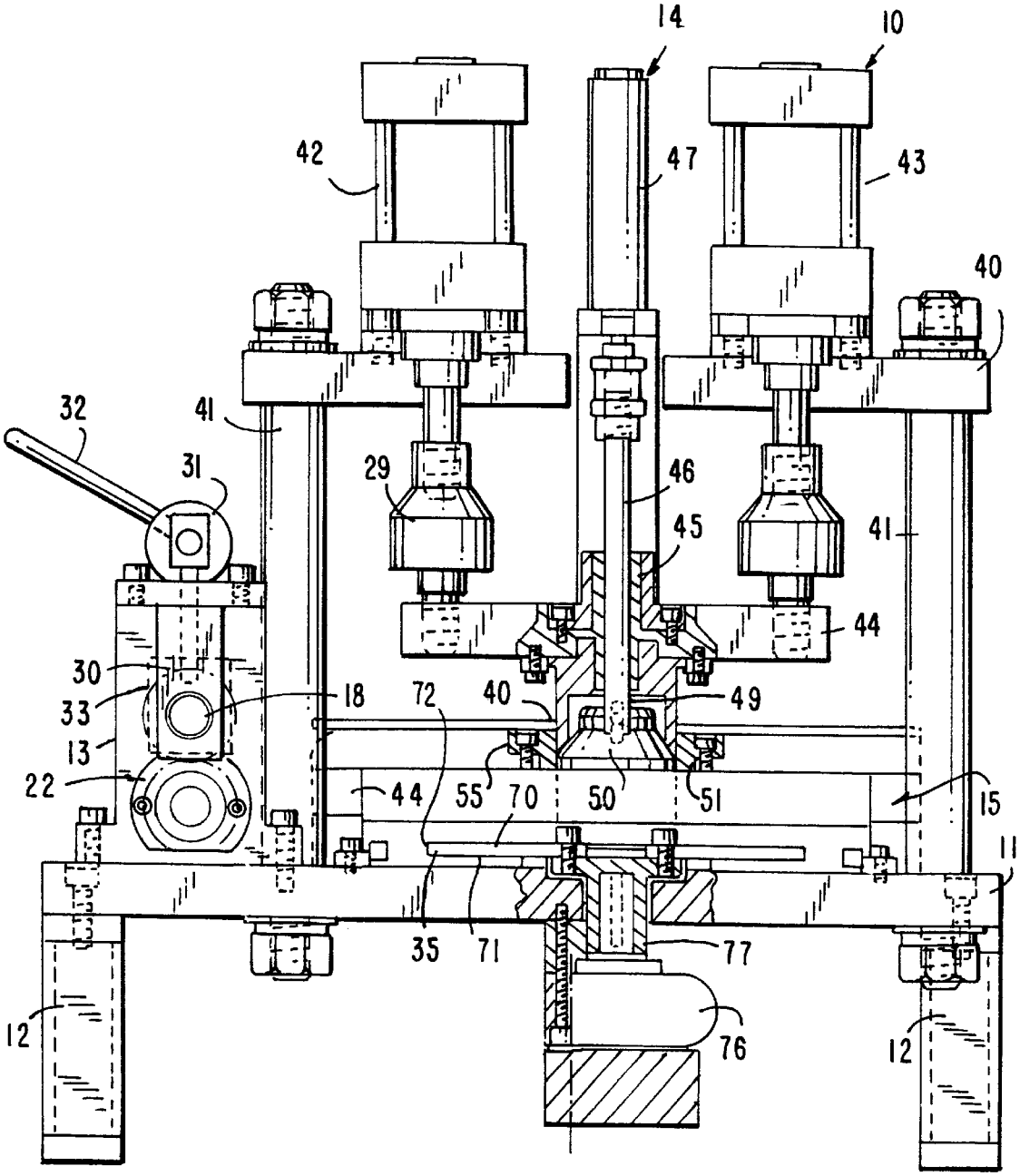
FIG. 2 is a schematic side elevational view thereof.
Figure 3:
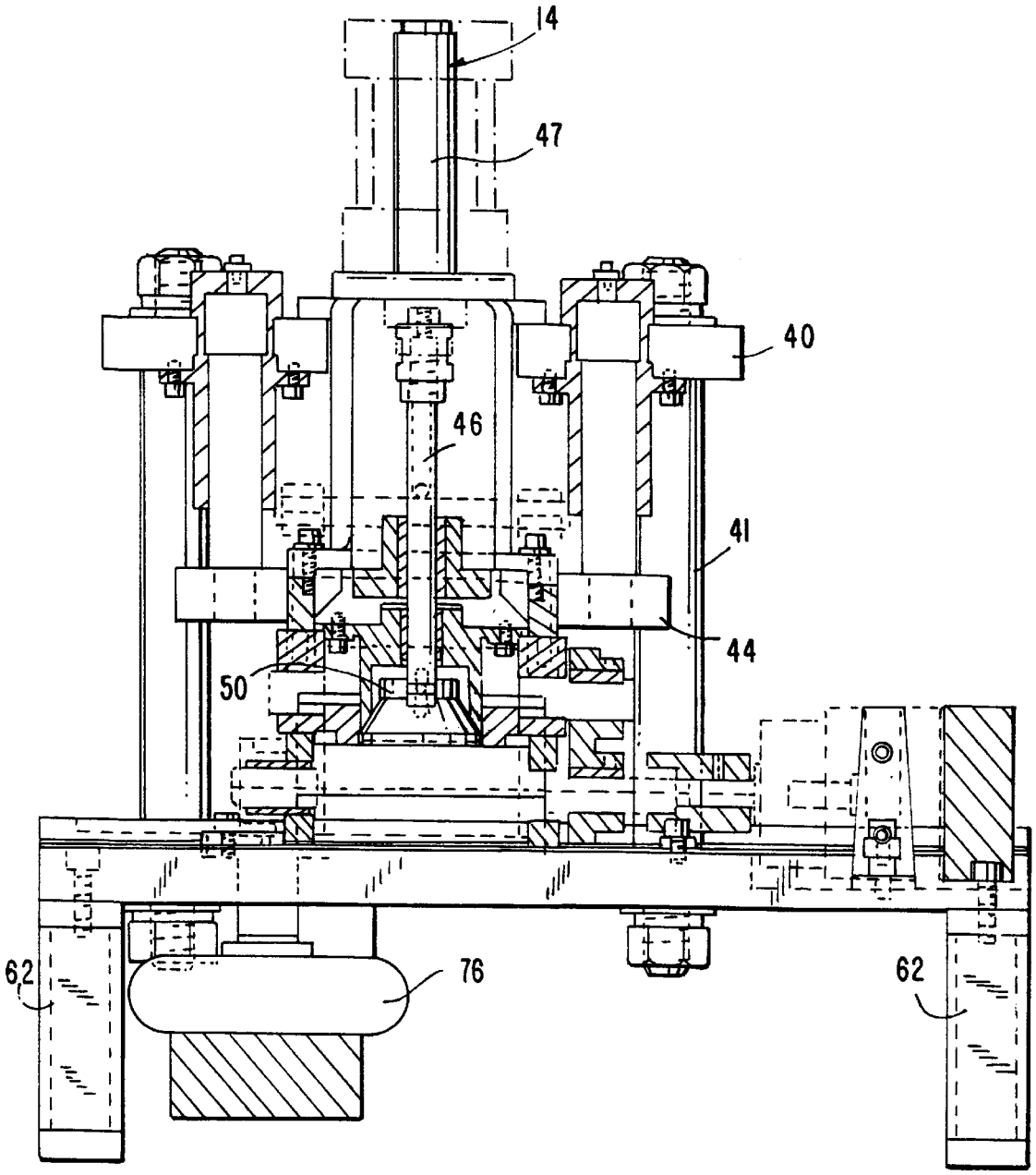
FIG. 3 is a schematic front elevational view thereof.

The upper nip roller 23 is carried by a mounting bracket or block 30 and is provided with a lifting cam 31 manually operated through a handle 32 to permit the web to be initially introduced or adjusted. The web feeds rightwardly as seen in FIG. 1 to overlie a die plate 35 having a circular opening.

The punch and die element 14 is supported upon a top plate 40 by a plurality of supports 41, and includes first and second air cylinders 42 and 43, respectively, which adjustably support a guide member 44 having a hollow bore 45 through which a push rod 46 reciprocates. The rod is driven by a centrally positioned air cylinder 47 which is computer controlled. A lower end 49 supports a push pad 50 which passes through a die ring 51 to enable the severed liner to be positioned within a closure.

The closure advancement element 15 includes a relatively small diameter pocket wheel 60 within a housing 61 defining a space 62 which accommodates a closure 63, typically of 28 mm diameter. The closures are fed between guide rails 64 and 65 from a source (not shown), typically, a hopper or the like. The closures pass along a rectilinear channel 66 to communicate with the pocket wheel 60. As will be more clearly apparent, the space 62 includes first and second exit areas 68 and 69 through which lined closures pass to a receptacle or conveyor belt (not shown), as is known in the art.

The pocket wheel will normally be less than three inches in diameter, and includes an upper surface 70, a lower surface 71, and an interconnecting peripheral surface 72 which defines first and second pockets 73 and 74 which are diametrically opposite each other. The wheel is supported upon a vertical shaft 75 driven by a vane-type actuator 76, the operation of which is also computer controlled through an interconnecting spline 77.

As previously mentioned, the vane actuator is preferably pneumatically operated, so that the entire device 10 may have a single power source. It is also possible to operate all of the disclosed air cylinders hydraulically, or where desirable, the actuator 76 as well as the actuator 24 may be powered by rack and pinion means (not shown) interconnected to a powered shaft.

The employment of vane actuators is possible, for the reason that the pocket wheel is of such small diameter and offers very low inertial torque. In prior art pocket wheels, the diameter is substantially larger, and the wheels themselves substantially heavier, with a far larger number of pockets, the wheel being incrementally advanced through relatively small angular displacements. By the use of a vane actuator, complicated indexing means are no longer required, and the time required for a single cycle of operation is limited only by the speed of the push rod 46 executing its reciprocating movement. Thus, the pocket wheel 60 has only two pockets, and the activator 76 drives the wheel alternately through a clockwise or counterclockwise movement of 180 degrees for each cycle. The wheel thus returns to its initial position on each alternate cycle.

I wish it to be understood that I do not consider the invention to be limited to the precise details of structure shown and described in the specification, for obvious modifications will occur to those skilled in the art to which the invention pertains.

I claim:

1. In a device for inserting a liner into a closure, including a punch and die means which serially cuts a liner from web material and seats the liner within a closure serially positioned beneath said punch and die means, the improvement comprising: a closure advancement element having a rotating pocket wheel, a shaft supporting said pocket wheel, and a rotary actuator driving said shaft; said actuator executing alternate rotational movement of 180 degrees for each cycle of punch and die operation to position one of two pockets on said pocket wheel beneath said punch and die means.

2. The improvement in accordance with claim 1, in which said actuator is pneumatically powered.

3. The improvement in accordance with claim 1, in which said actuator is hydraulically powered.

4. The improvement in accordance with claim 1, in which said pocket wheel includes first and second pockets positioned diagonally opposite each other.

* * * * *